US007312389B2

(12) United States Patent
Okamoto

(10) Patent No.: US 7,312,389 B2
(45) Date of Patent: Dec. 25, 2007

(54) SNARE STRAINER

(75) Inventor: Shigehiro Okamoto, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 157 days.

(21) Appl. No.: 11/056,513

(22) Filed: Feb. 11, 2005

(65) Prior Publication Data

US 2005/0188818 A1 Sep. 1, 2005

(30) Foreign Application Priority Data

Feb. 16, 2004 (JP) ..... 2004-037957

(51) Int. Cl.
*G10D 13/02* (2006.01)

(52) U.S. Cl. ..... 84/415; 84/411 R

(58) Field of Classification Search ..... 84/415, 84/416, 417, 411 R
See application file for complete search history.

(56) References Cited

U.S. PATENT DOCUMENTS

| | | | | |
|---|---|---|---|---|
| 5,557,053 | A * | 9/1996 | Nickel | 84/415 |
| 5,844,157 | A | 12/1998 | Kasha | |
| 6,008,445 | A | 12/1999 | Chen | |

FOREIGN PATENT DOCUMENTS

| | | |
|---|---|---|
| JP | 58-4141 | 1/1983 |
| JP | 58-50372 (U) | 11/1983 |
| JP | 60-163500 | 10/1985 |
| JP | 4-93889 | 8/1992 |
| JP | 7-39093 | 7/1995 |
| JP | 2002-202774 | 7/2002 |

* cited by examiner

*Primary Examiner*—Lincoln Donovan
*Assistant Examiner*—Jianchun Qin
(74) *Attorney, Agent, or Firm*—William L. Androlia; H. Henry Koda

(57) ABSTRACT

A snare strainer includes first and second strainers for respectively holding both ends of a snare assembly (i.e., snares), which is controlled to move in close contact with or apart from a bottom-side drumhead of a snare drum. The first strainer includes a fixed base and a snare stretching member, which further includes a holding member for holding a snare connection member, an interconnection member, a pair of arms attached to both ends of the interconnection member, a pair of levers respectively attached to the arms, and a stretching rod that is bridged between the levers to support the intermediate portion of the snare connection member. The first strainer further includes a tension adjuster for adjusting the tension of the snare connection member, and a height adjuster for adjusting the height of the stretching rod.

8 Claims, 7 Drawing Sheets

SNARE STRAINER

BACKGROUND OF THE INVENTION

1. Field of the Invention

This invention relates to snare strainers that control snare assemblies (including snares) to move in close contact with or apart from drumheads.

This application claims priority on Japanese Patent Application No. 2004-37957, the content of which is incorporated herein by reference.

2. Description of the Related Art

Snare drums produce special sound effects called tumbling effects, wherein snare assemblies each corresponding to a plurality of fine snares are controlled to move in close contact with or apart from bottom-side drumheads (corresponding to non-striking sides of snare drums), or they are controlled to move in close contact with or apart from both of bottom-side drumheads and top-side drumheads (corresponding to striking sides of snare drums), so that vibrations of drumheads are transmitted to snares to produce pattering or rattling sounds having light tone colors. The following documents teach adjustments of snares adapted to snare drums.

(a) Japanese Examined Utility Model Publication No. S58-50372.

(b) U.S. Pat. No. 6,008,445.

(c) U.S. Pat. No. 5,844,157.

FIG. 10 is a perspective view showing the exterior appearance of a snare drum equipped with a snare assembly in relation to a bottom-side drumhead; and FIG. 11 is a perspective view showing the exterior appearance of the snare drum viewed from the top-side drumhead thereof. Reference numeral 1 designates a snare drum; reference numeral 2 designates a drum shell, i.e., a drum cylinder having openings at both ends; reference numeral 3 designates a bottom-side drumhead covering the bottom-side opening of the drum cylinder 2; reference numeral 4 designates a top-side drumhead covering the top-side opening of the drum cylinder 2; reference numerals 5 designate hoops (or clamp frames) engaging with the peripheries of the openings of the drum cylinder 2; reference numerals 6 designate lugs; reference numerals 7 designate bolts for interconnecting the hoops 5 and the lugs 6 together; reference numeral 8 designates a snare assembly (i.e., snares) attached in relation to the bottom-side drumhead 3; reference numeral 9 designates a first strainer for holding a movable end 8A of the snare assembly 8; and reference numeral 10 designates a second strainer for holding a fixed end 8B of the snare assembly 8. A snare strainer is constituted by the first strainer 9 and the second strainer 10.

The snare assembly 8 includes a plurality of fine snares 11 that are arranged in parallel with each other in the longitudinal direction with prescribed distances therebetween, a pair of snare mounting plates 12 that are respectively soldered to both ends of the snares 11, and a pair of snare connection members having flexibility that are respectively attached to the snare mounting plates 12. The snare connection members 13 constituted by belts are pressed by pressure plates 14 and 26 and are detachably attached to the first strainer 9 and the second strainer 10 respectively. The snare mounting plates 12 are arranged inside of the hoop 5 to come in close contact with the bottom-side drumhead 3 together with the snares 11. This snare assembly 8 is referred to as an internal contact type snare assembly. In contrast, a full contact type snare assembly is designed such that the ends of snares 11 and the snare mounting plates 12 are arranged outside of the hoop 5.

The first strainer 9 controls the movable end 8A of the snare assembly 8 to move in close contact with or apart from the bottom-side drumhead 3. Specifically, the first strainer 9 is constituted by a fixed base 15 that is fixed to a prescribed position on the exterior circumferential surface of the drum cylinder 2, a moving base 16 that can be freely moved with respect to the fixed base 15 in vertical directions A and B, a switch mechanism 17 that switches over the vertical movement of the moving base 16 with respect to the fixed base 15 so as to control the movable end 8A of the snare assembly 8 to move in close contact with or apart from the bottom-side drumhead 3, and a tension adjustment screw 18 that controls the vertical movement of the moving base 16 with respect to the fixed base 15 so as to perform fine adjustment on the tension applied to the snare assembly 8. The snare connection member 13 is tightly held between the pressure plate 14 and the moving base 16, wherein the pressure plate 14 is fixed to the moving base 16 by means of two square-headed bolts 19.

The switch mechanism 17 includes an operation lever 20 whose rotation is converted into a linear motion by means of a link or a cam (not shown) and is transmitted to the moving base 16. Generally, two types of operations can be adapted to the operation lever 20, wherein in the case of FIG. 11, the operation lever 20 is moved in circumferential directions C and D along the exterior circumferential surface of the drum cylinder 2, and in the case of FIG. 12, the operation lever 20 is moved in diameter directions E and F perpendicular to the exterior circumferential surface of the drum cylinder 2.

In FIG. 10, the second strainer 10 is constituted by a fixed base 23 that is fixed to a prescribed position on the exterior circumferential surface of the drum cylinder 2, a moving base 24 that can be vertically moved with respect to the fixed base 23, and a tension adjustment screw 25 that controls the vertical movement of the moving base 24 so as to perform fine adjustment on the tension applied to the snare assembly 8. The snare connection member 13 attached to the fixed end 8B of the snare assembly 8 is tightly held between the moving base 24 and the pressure plate 26.

According to the snare strainer including the first strainer 9 and the second strainer 10, when the snare drum 1 is played without using the snare assembly 8, the switch mechanism 17 of the first strainer 9 is controlled to move the moving base 16 forward in the direction A, whereby the tension applied to the snares 11 of the snare assembly 8 is reduced so that both the snares 11 and the snare mounting plate 12 move apart from the bottom-side drumhead 3. When the snare drum 1 is played by use of the snare assembly 8, the switch mechanism 17 is controlled to move the moving base 16 backward in the direction B, whereby the snare connection member 13 is stretched so as to increase the tension of the snares 11, so that both the snares 11 and the snare mounting plate 12 move in close contact with the bottom-side drumhead 3. In this 'contact' condition, when the top-side drumhead 4 is struck by a drumstick and the like, vibration occurring on the top-side drumhead 4 is transmitted to the snares 11 via the bottom-side drumhead 3, whereby the snares 11 correspondingly vibrate so as to produce unique sound of the snare drum 1, i.e., pattering or rattling sound having a light tone color.

As described above, the first strainer 9 is designed such that the snare connection member 13 is fixed onto the moving base 16. In order to control the snare assembly 8 to move in close contact with or apart from the bottom-side drumhead 3, the first strainer 9 requires a specific mechanism for moving the moving base 16, wherein the rotary motion of the operation lever 20 is converted into the linear motion by means of a link or a cam and is then transmitted to the moving base 16. This requires an appropriate clearance allowing smooth sliding movement between the fixed base 15 and the moving base 16, which in turn causes a problem in that when the moving base 16 slides to move vertically during drum playing, the moving base 16 may easily rattle and produce noise.

The aforementioned problem may be solved by minimizing the clearance so as to prevent the moving base 16 from rattling. However, this requires strict dimensional tolerance and therefore increases the manufacturing cost. In addition, this may cause a relatively large friction when the moving base 16 is slid to move vertically; hence, it becomes difficult to smoothly move the moving base 16.

SUMMARY OF THE INVENTION

It is an object of the invention to provide a snare strainer having a simple structure with a reduced number of parts that do not require high precision in dimensions, wherein the snare strainer can be operated smoothly so as to avoid the occurrence of rattling and noise.

In a first aspect of the invention, a snare strainer includes a first strainer and a second strainer, which are attached to the exterior circumferential surface of a drum cylinder of a snare drum at opposite positions and by which a snare assembly including snares is controlled to move in close contact with or apart from a bottom-side drumhead of the snare drum. The first strainer is constituted by a holding member for holding a snare connection member attached to a prescribed end of the snare assembly, and a stretching rod that is positioned to move between the holding member and the outer peripheral end of the bottom-side drumhead so as to support the intermediate portion of the snare connection member. Herein, the stretching rod moves to vary a distance of a path in which the snare connection member is supported by way of the holding member, the stretching rod, and the outer peripheral end of the bottom-side drum, thus controlling the snare assembly to move in close contact with or apart from the bottom-side drumhead.

In the above, the first strainer includes a snare stretching member having the stretching rod and a fixed base, which fixes the snare stretching member onto the exterior circumferential surface of the drum cylinder, wherein the fixed base further includes a height adjuster that adjusts the height of the stretching rod, which is measured in level based on the bottom-side drumhead, by operating the snare stretching member. In addition, the holding member further includes a tension adjuster for adjusting tension applied to the snare assembly.

In a second aspect of the invention, a snare strainer includes the first and second strainers described above, wherein the snare stretching member further includes an interconnection member for establishing interconnection with the fixed base, and a pair of arms that are elongated from both ends of the interconnection member, and wherein a pair of levers, between which the stretching rod is bridged, are respectively attached to the arms so as to freely rotate about rotation axes, whereby by rotating the levers, the snare assembly moves in close contact with or apart from the bottom-side drumhead.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

This invention will be described in further detail by way of examples with reference to the accompanying drawings.

Figure 10:
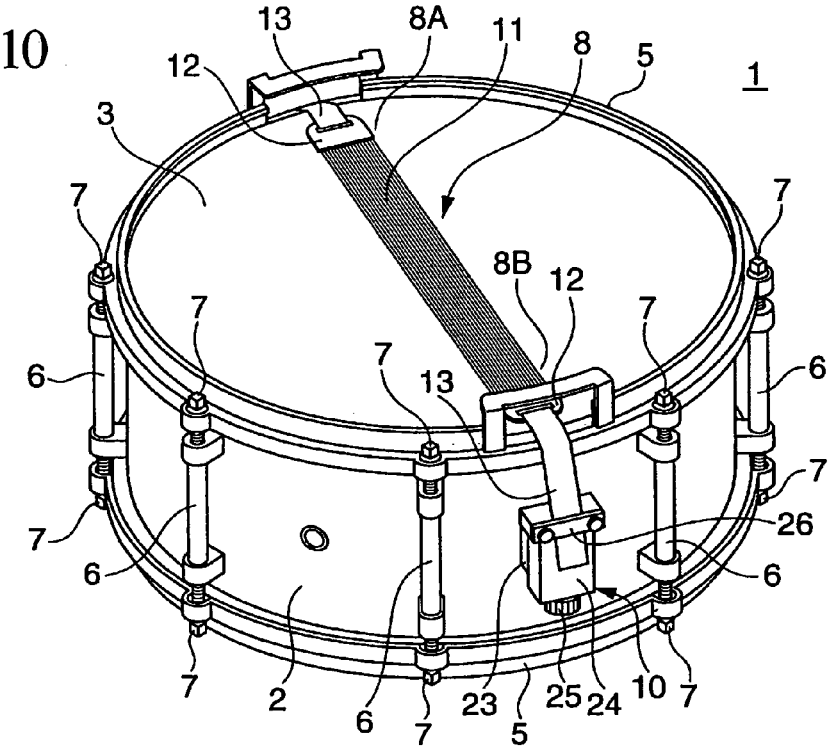
FIG. 10 is a perspective view showing the exterior appearance of a conventionally known snare drum equipped with a snare strainer controlling a snare assembly to move in close contact with or apart from a bottom-side drumhead.
Figure 11:
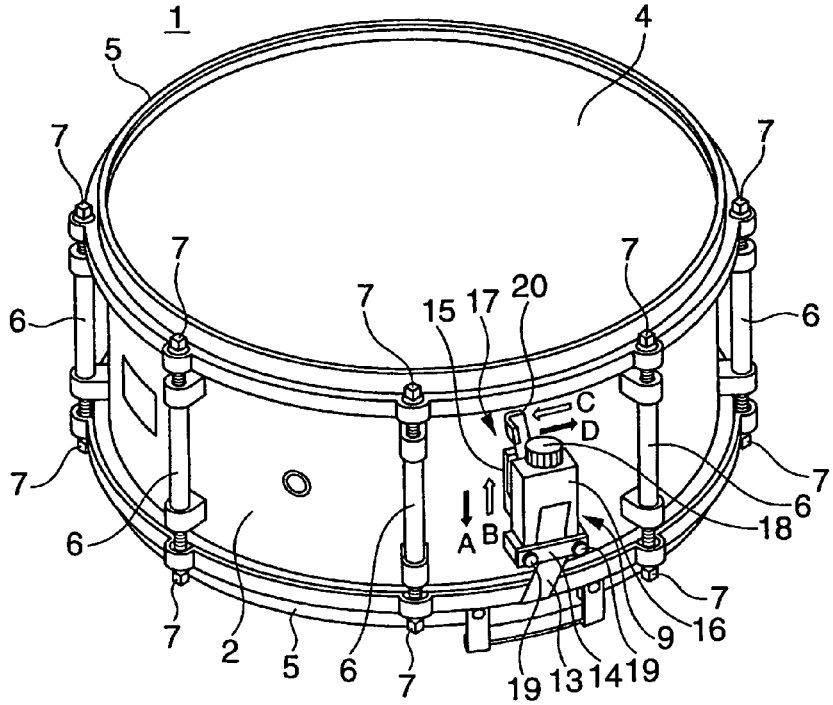
FIG. 11 is a perspective view showing the snare drum viewed from a top-side drumhead.
Figure 12:
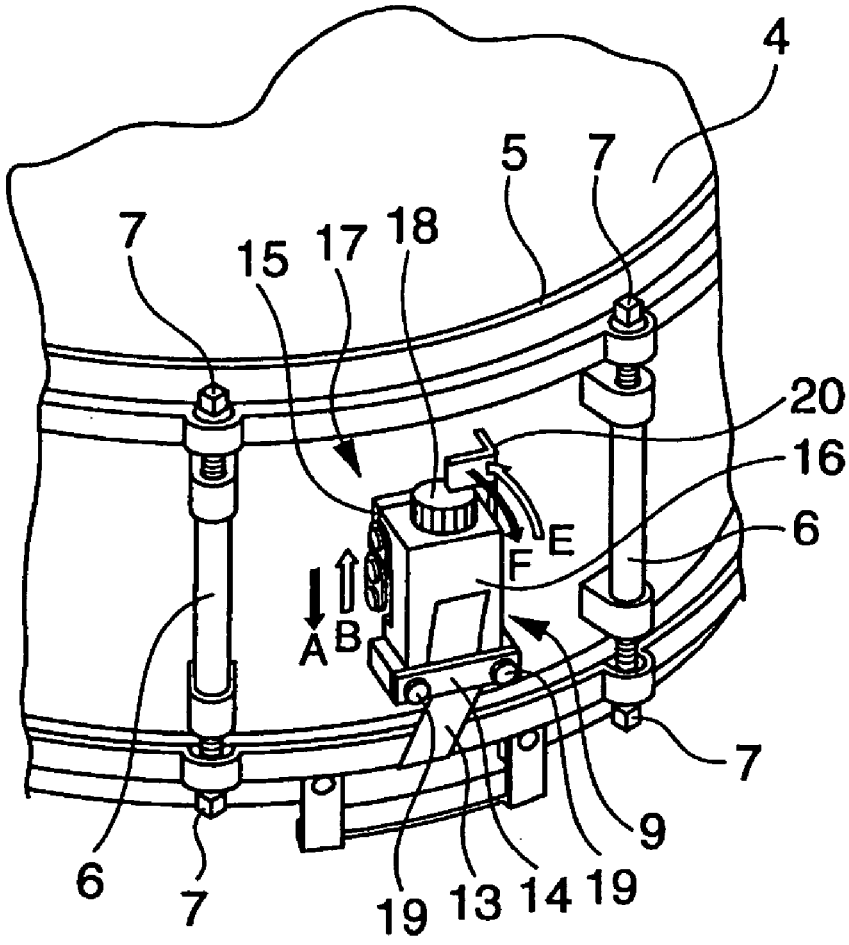
FIG. 12 is a fragmentary perspective view showing another example the snare strainer attached to the snare drum.

A snare strainer according to a preferred embodiment of the invention will be described in detail with reference to FIGS. 1 to 7, wherein parts identical to those shown in FIGS. 10 to 12 are designated by the same reference numerals; hence, the detailed description thereof will be omitted as necessary.

Figure 1:
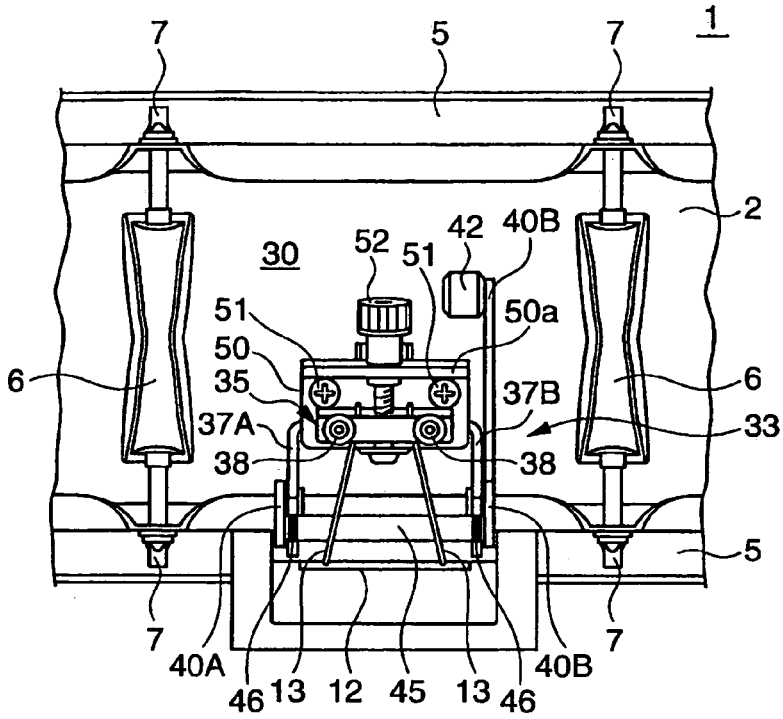
FIG. 1 is a front view showing a first strainer included in a snare strainer in accordance with a preferred embodiment of the invention, wherein the first strainer is placed in an ON state allowing a snare assembly to move in close contact with a bottom-side drumhead of a snare drum.
Figure 2:
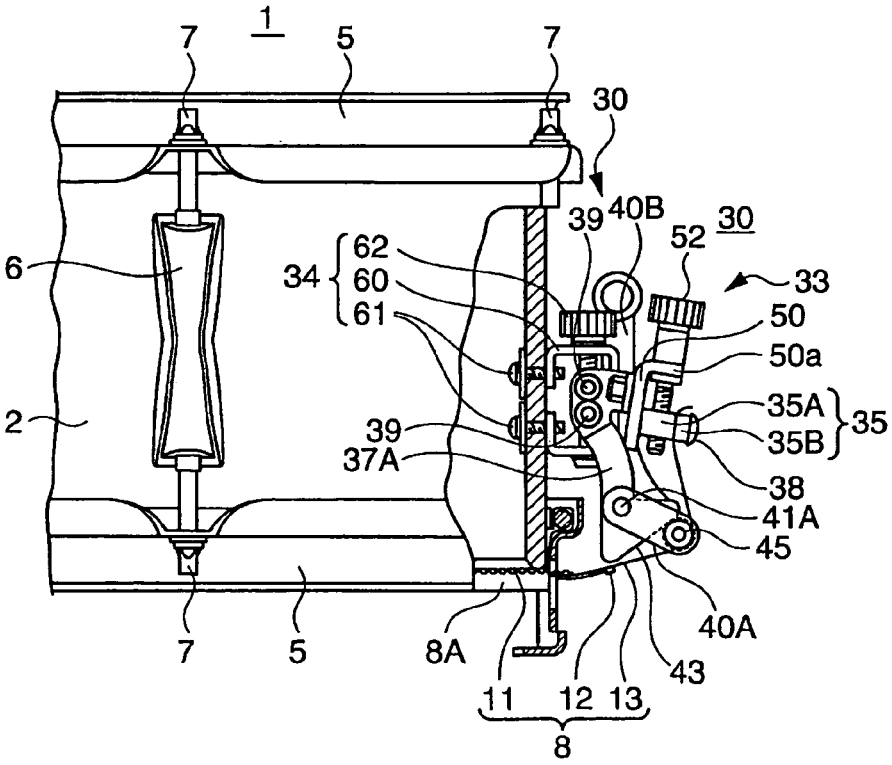
FIG. 2 is a side view partly in cross section showing the first strainer in the ON state.
Figure 3:
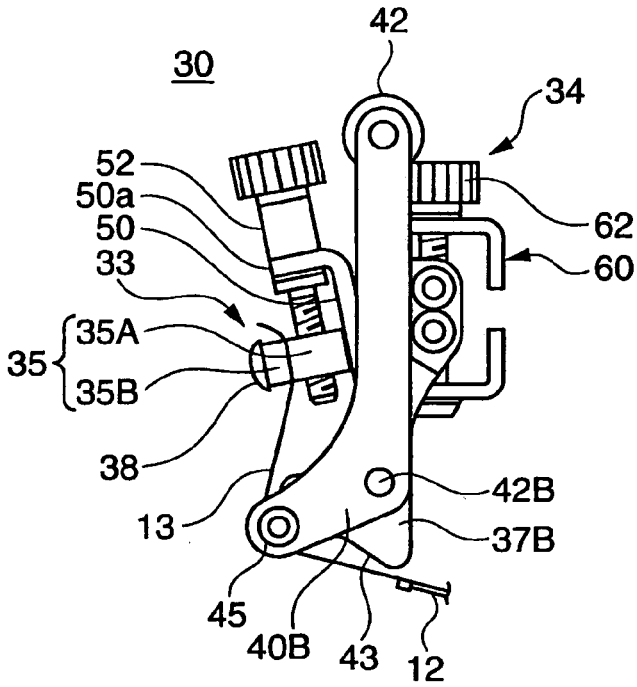
FIG. 3 is an enlarged side view of the first strainer in the ON state, which is viewed from the right side in FIG. 1.
Figure 4:
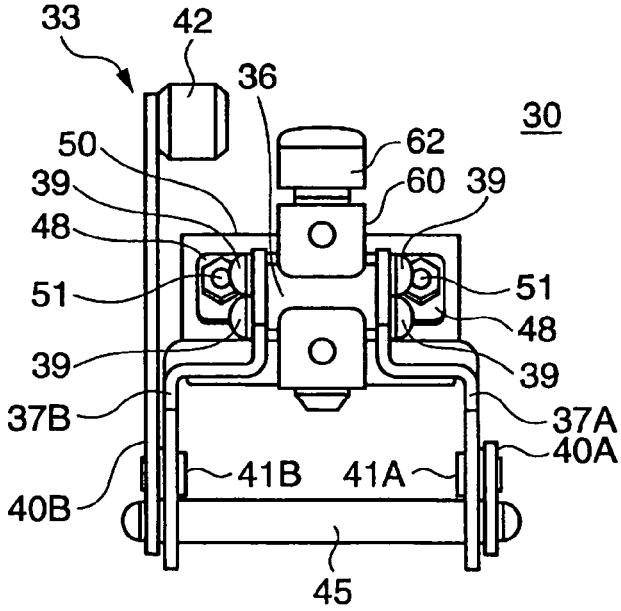
FIG. 4 is an enlarged rear view of the first strainer in the ON state.
Figure 5:
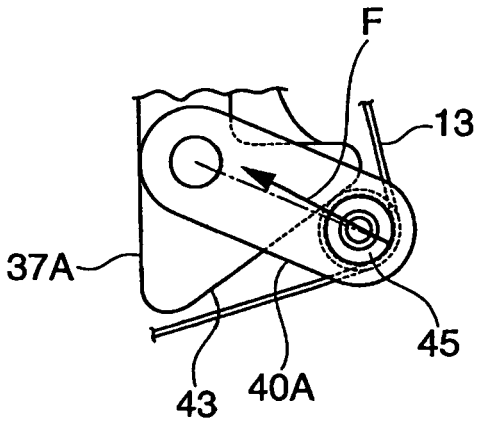
FIG. 5 is an enlarged view showing essential parts of the first strainer in the ON state.
Figure 6:
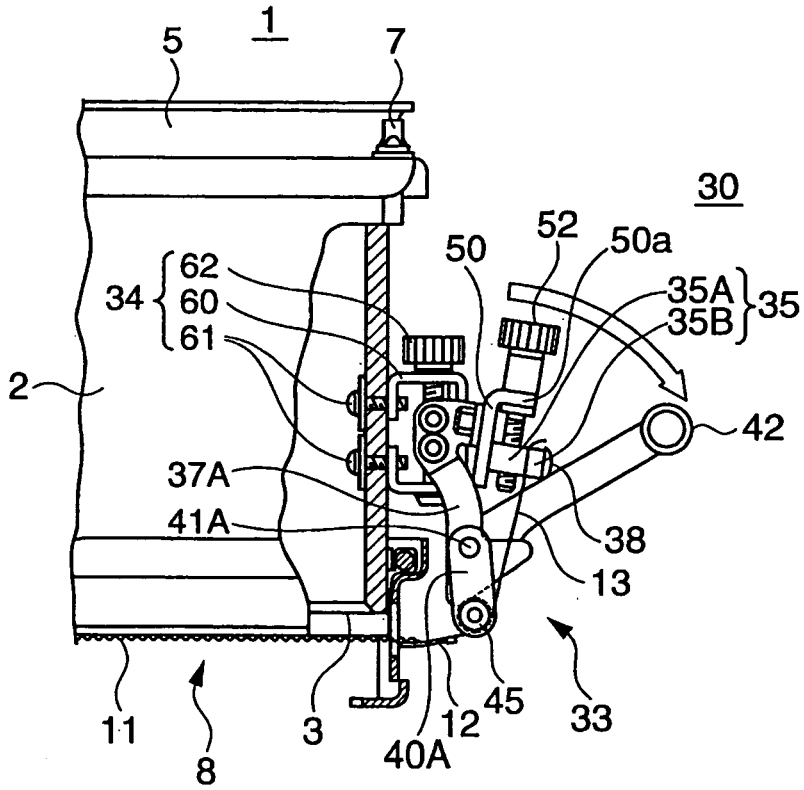
FIG. 6 is a side view partly in cross section showing the first strainer in an OFF state allowing the snare assembly to move apart from the bottom-side drumhead of the snare drum.
Figure 7:
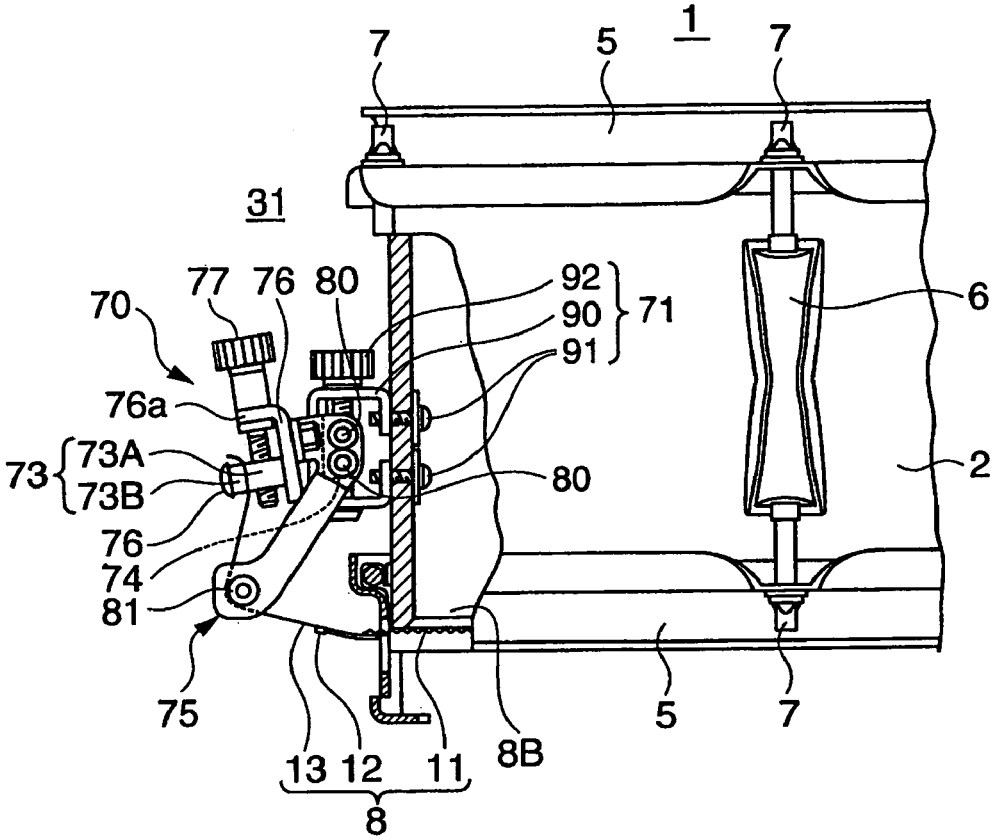
FIG. 7 is a side view partly in cross section showing a second strainer in the ON state allowing the snare assembly to move in close contact with the bottom-side drumhead of the snare drum.

FIG. 1 is a front view showing a first strainer that is placed in an ON state allowing a snare assembly to move in close contact with a bottom-side drumhead of a snare drum; FIG. 2 is a side view partly in cross section showing the first strainer in the ON state; FIG. 3 is an enlarged side view of the first strainer in the ON state, which is viewed from the right side in FIG. 1; FIG. 4 is an enlarged rear view of the first strainer in the ON state; FIG. 5 is an enlarged view showing essential parts of the first strainer in the ON state; FIG. 6 is a side view partly in cross section showing the first strainer in an OFF state allowing the snare assembly to move apart from the bottom-side drumhead of the snare drum; and FIG. 7 is a side view partly in cross section showing a second strainer in the ON state allowing the snare assembly to move in close contact with the bottom-side drumhead of the snare drum.

Specifically, in FIGS. 1 to 7, a first strainer 30 and a second strainer 31 are respectively attached to opposite positions on the exterior circumferential surface of a drum cylinder 2 of a snare drum 1, wherein they are assembled together to form a snare strainer that controls a snare assembly 8 to move in close contact with or apart from a bottom-side drumhead 3 of the snare drum 1.

The snare assembly 8 is constituted by a plurality of fine snares 11 that are arranged in parallel with each other with prescribed distances therebetween, a pair of snare mounting plates 12 that are respectively soldered to both ends of the snares 11, and snare connection members 13 corresponding to wires or strings that are respectively attached to the snare mounting plates 12. In the present embodiment, the snare assembly 8 is of a full contact type in which both ends of the snares 11 and the snare mounting plates 12 are arranged outside of a hoop 5. The snare connection members 13 are held by holding members 35 and 73 included the first strainer 30 and the second strainer 31 respectively.

With reference to FIGS. 1 to 6, the first strainer 30 includes a snare stretching member 33 and a fixed base 34, which fixes the snare stretching member 33 to the exterior circumferential surface of the drum cylinder 2.

The snare stretching member 33 is constituted by the holding member 35 for holding the snare connection member 13 attached to one end '8A' of the snare assembly 8, an interconnection member 36 (see FIG. 4) interconnected with the fixed base 34, and a pair of arms 37A and 37B respectively fixed to both sides of the interconnection member 36.

The holding member 35 is constituted by a pair of a first holding member 35A and a second holding member 35B that are combined together to tightly hold the end portion of the snare connection member 13 and are integrally connected together via screws 38.

The interconnection member 36 is formed in a block-like shape in which an internally threaded hole is formed at the center position to vertically penetrate therethrough, whereby it is attached to the fixed base 34, and it can be vertically moved by means of a height adjustment screw 62.

As shown in FIG. 4, the arms 37A and 37B are shaped symmetrically to each other, and the front ends thereof are fixed to both sides of the interconnection member 36 via screws 39. A pair of levers 40A and 40B are attached to the arms 37A and 37B in a free rotation manner. The rear ends of the arms 37A and 37B have slopes 43, which are arranged opposite to the exterior circumferential surface of the drum cylinder 2 and are respectively inclined by prescribed angles relative to the exterior circumferential surface of the drum cylinder 2.

As shown in FIG. 1, the 'left-side' lever 40A has a shorter length compared with the 'right-side' lever 40B, wherein the front end thereof is supported by the rear end of the arm 37A to freely rotate about a rotation axis 41A. The right-side lever 40B is sufficiently elongated in length compared with the left-side arm 40A, wherein the front end thereof is extended forwards in proximity to the fixed base 34. A knob 42 is fixed to the front end of the lever 40B so as to form a switch lever (designated by the reference numeral 40B), which switches over the snare assembly 8 to move in close contact with or apart from the bottom-side drumhead 3. As shown in FIG. 3, the switch lever 40B is formed roughly in an L-shape in side view, the center of which matches a rotation axis 41B. Herein, the rear end of the switch lever 40B is inclined relative to the exterior circumferential surface of the drum cylinder 2 and is elongated in a direction departing from the exterior circumferential surface of the drum cylinder 2, wherein the center of the bent portion of the switch lever 40B is supported by the rear end of the arm 37B in a free rotation manner about the rotation axis 41B. Both the rotation axes 41A and 41B match each other in line.

A stretching rod 45 for supporting a portion between the holding member 35 and an outer peripheral end of the drumhead of the snare connection member 13 is bridged between the rear ends of the levers 40A and 40B. As shown in FIG. 5, in the ON state allowing the snare assembly 8 to come in close contact with the bottom-side drumhead 3, the stretching rod 45 comes in close contact with the front ends of the slopes 43 of the arms 37A and 37B. In this case, the resultant (i.e., the sum of vectors) F of the tension applied to the snare assembly 13 is directed upwardly compared with the axial line of the lever 40A, so that the switch lever 40B is maintained in the ON state. In the OFF state in which the snare assembly 8 moves apart from the bottom-side drumhead 3, as shown in FIG. 6, the stretching rod 45 slightly descends down and moves closer to the exterior circumferential surface of the drum cylinder 2, so that it comes in contact with the rear end of the slope 43. That is, the front ends and rear ends of the slopes 43 of the arms 37A and 37B function as stoppers for stopping the stretching rod 45 at an ON position and an OFF position respectively. O-rings 46 (see FIG. 1) are attached to both ends of the stretching rod 45, which comes in contact with the slopes 43 of the arms 37A and 37B, in order to avoid the occurrence of noise. The function of the switch lever 40B can be realized by partially modifying the stretching rod 45 to be elongated outside of the arm 37B so that the elongated portion thereof serves as a switch knob.

As shown in FIG. 4, fixing portions that are outwardly bent and folded are respectively attached to the front ends of the arms 37A and 37B. A bracket 50 that is roughly bent in an L-shape is fixed onto the fixing portions 48 via screws 51. The holding member 35 is attached onto the upper surface of the bracket 50, wherein the holding member 35 and the bracket 50 are interconnected together by means of a tension adjuster 52, which is used to adjust the tension applied to the snare connection member 13 and is constituted by a screw having a knob. The tension adjuster 52 is inserted into a leading wall 50*a*, which is formed at the front end of the bracket 50, in a free rotation manner but is not allowed to be vertically moved, wherein it is engaged with an internally threaded hole formed at the center of the first holding member 35A. That is, when the tension adjuster 52 is rotated, the first holding member (in other words, the holding member 35) moves upwards or downwards along the surface of the bracket 50. This allows the snare assembly 8 to be expanded or contracted in the length direction thereof while the snare assembly 8 is fixedly set in close contact with the bottom-side drumhead 3. Thus, it is possible to adjust the tension applied to the snares 11 of the snare assembly 8.

As shown in FIG. 2, the fixed base 34 is constituted by a fixing member 60 that is formed by bending work using a metal plate and, a plurality of screws 61 for fixing the fixing member 60 onto the circumferential wall of the drum cylinder 2, and a height adjuster 62 for interconnecting the interconnection member 36 with the fixing member 60, wherein the fixing member 60 is formed in a rectangular shape in side view, both sides of which are opened. The height adjuster 62 adjusts the vertical height of the stretching rod 45. Similar to the tension adjuster 52, the height adjuster 62 is constituted by a screw having a knob. The height adjuster 62 is inserted into through holes, which are formed to penetrate through the upper and lower portions of the fixing member 60, in a free rotation manner but is not allowed to be vertically moved, wherein it is engaged with an internally threaded hole formed in the interconnection member 36. When the height adjuster 62 is rotated, the interconnection member 36 moves upwards or downwards along the height adjuster 62. Thus, it is possible to adjust the height of the stretching rod 45 measured from the level of the bottom-side drumhead 3 while the snare assembly 8 is set in close contact with the bottom-side drumhead 3.

Similar to the first strainer 30, as shown in FIG. 7, the second strainer 31 includes a snare stretching member 70 and a fixed base 71 for fixing the snare stretching member 70 onto the exterior circumferential surface of the drum cylinder 2.

The snare stretching member 70 is constituted by a holding member 73 for holding the snare connection member 13, which is attached to the other end (i.e., '8B') of the snare assembly 8, an interconnection member 74 interconnected with the fixed base 71, and a pair of arms 75 fixed to both ends of the interconnection member 74.

The holding member 73 is constituted by a pair of a first holding member 73A and a second holding member 73B, which are integrally connected together via screws 76 so as to tightly hold the end portion of the snare connection member 13.

The interconnection member 74 is formed in a block-like shape having an internally threaded hole, which is formed at the center thereof to vertically penetrate therethrough. The interconnection member 74 is attached to the fixed base 71 in a vertically movable manner. A bracket 76 is fixed onto the upper surface of the interconnection member 74. The holding member 73 is attached to the bracket 76 in a vertically movable manner, wherein the holding member 73 is interconnected with the bracket 76 by means of a tension adjuster 77 for adjusting the tension applied to the snare connection member 13.

The tension adjuster 77 is constituted by a screw having a knob, wherein it is attached to a leading wall 76*a*, which is formed at the front end of the bracket 76, in a free rotation manner but is not allowed to be vertically moved. The tension adjuster 77 is engaged with an internally threaded hole that is formed at the center of the first holding member 73A. When the tension adjuster 77 is rotated, the first holding member 73A (in other words, the holding member 73) moves upwards or downwards along the surface of the bracket 76. Thus, it is possible to adjust the tension of the snare assembly 8 (in other words, the tension applied to the snares 11 of the snare assembly) while the snare assembly is set in close contact with the bottom-side drumhead 3.

A pair of arms 75 each having a bent shape in side view are formed symmetrical to each other, wherein the front ends thereof are fixed to both sides of the interconnection member 74 via screws 80, and the rear ends thereof are elongated to depart from the exterior circumferential surface of the drum cylinder 2 and are arranged to cross each other at a prescribed angle therebetween with respect to the exterior circumferential surface of the drum cylinder 2. A stretching rod 81 for supporting the intermediate portion of the snare connection member 13 is bridged between the rear ends of the arms 75.

The fixed base 71 is constituted by a fixing member 90 that is formed by bending work using a metal plate and, a plurality of screws 91 for fixing the fixing member 60 onto the circumferential wall of the drum cylinder 2, and a height adjuster 92 for interconnecting the interconnection member 74 with the fixing member 90, wherein the fixing member 90 is formed in a rectangular shape in side view, both sides of which are opened. The height adjuster 92 adjusts the vertical height of the stretching rod 81. Similar to the tension adjuster 77, the height adjuster 92 is constituted by a screw having a knob. The height adjuster 92 is inserted into through holes, which are formed to penetrate through the upper and lower portions of the fixing member 90, in a free rotation manner but is not allowed to be vertically moved, wherein it is engaged with an internally threaded hole formed in the interconnection member 74. When the height adjuster 92 is rotated, the interconnection member 74 moves upwards or downwards along the height adjuster 92. Thus, it is possible to adjust the height of the stretching rod 81 measured from the level of the bottom-side drumhead 3 while the snare assembly 8 is set in close contact with the bottom-side drumhead 3.

The second strainer 31 is constituted basically similar to the aforementioned first strainer 30 except the following points:

(a) The second strainer 31 does not have a lever for controlling the snare assembly 8 to move in close contact with or apart from the bottom-side drumhead 3.

(b) Because of the aforementioned point, the 'second' stretching rod 81 is bridged between the rear ends of the arms 75.

In order to play the snare drum 1 having the snare strainer including the first strainer 30 and the second strainer 31 in the OFF state in which the snare assembly 8 is not brought in close contact with the bottom-side drumhead 3, the switch lever 40B of the first strainer 30 (which is originally maintained vertically as shown in FIG. 2) is rotated by a prescribed angle in a clockwise direction as shown in FIG. 6 and is thus inclined with respect to the exterior circumferential surface of the drum cylinder 2. When the switch lever 40B is rotated by a prescribed angle in the clockwise direction, the 'first' stretching rod 45 of the first strainer 30 descends down to move close to the exterior circumferential surface of the drum cylinder 2, thus releasing the tension of the snare assembly 13, wherein it comes in contact with the rear ends of the slopes 43 of the arms 37A and 37B. Since the snare assembly 8 is released from the stretched condition thereof, it naturally moves downwards due to its own weight and separates from the bottom-side drumhead 3. Thus, it is possible to switch over the snare assembly 8 from the ON state to the OFF state in which the snare drum 1 is played without using the snare assembly 8.

In order to perform fine adjustment on the tension of the snare assembly 8 (i.e., the tension applied to the snares 11), it is necessary for a player to manually rotate the tension adjusters 52 and 77 included in the first strainer 30 and the second strainer 31 respectively. That is, when the player rotates the tension adjuster 52 and 77 in a tightening direction so as to move the holding member 35 and 73 upwards, the snare connection members 13 are correspondingly lifted up so that the tension applied to the snares 11 increases. In contrast, when the player rotates the tension adjuster 52 and 77 in a loosening direction so as to move the holding members 35 and 73 downwards, the snare assemblies 13 are correspondingly lowered in positions so that the tension applied to the snares 11 decreases.

In order to perform fine adjustment on the degree of contact established between the snare assembly 8 and the bottom-side drumhead 3, it is necessary for a player to manually rotate the height adjusters 62 and 92 so as to move the arms 37A, 37B, and 75 respectively. That is, when the player rotates the height adjuster 62 and 92 in a tightening direction so as to move the arms 37A, 37B, and 75, the stretching rod 45 bridged between the levers 40A and 40B interconnected with the arms 37A and 37B moves vertically so as to increase the degree of contact. In contrast, when the player rotates the height adjusters 62 and 92 in a loosening direction so as to move the arms 37A, 37B, and 75 backwards, the stretching rod 45 is lowered in position so that the distance between the snare assembly 8 and the bottom-side drumhead 3 increases; thus, it is possible to decrease the degree of contact with respect to the snare assembly 8, whereby the snares 11 are placed in 'weak' contact with the bottom-side drumhead 3.

According to the present embodiment, the switch lever 40B is attached to the arm 37B in a free rotation manner, and the stretching rod 45 bridged between the levers 40A and 40B supports the intermediate portion of the snare connection member 13. Thus, it is possible to simplify the structure of the switch mechanism and to thereby reduce the total number of parts; and it is possible to avoid the occurrence of rattling and noise due to the switch lever 40B.

In addition, the present embodiment can be commonly adapted to both the internal contact type of the snare assembly and the full contact type of the snare assembly.

Furthermore, the present embodiment allows the stretching rod 45 to rotate in the same direction in which the switch lever 40B rotates, thus switching over the ON/OFF states with respect to the snare assembly 8. This eliminates the necessity of arranging a moving direction converting mechanism in which the rotary motion is converted into the linear motion. The stretching rod 45 can be smoothly moved without causing rattling and noise.

Next, a modified example of the present embodiment will be described with reference to FIGS. 8 and 9, wherein parts identical to those shown in FIGS. 1 to 6 are designated by the same reference numerals; hence, the detailed description thereof will be omitted.

Figure 8:
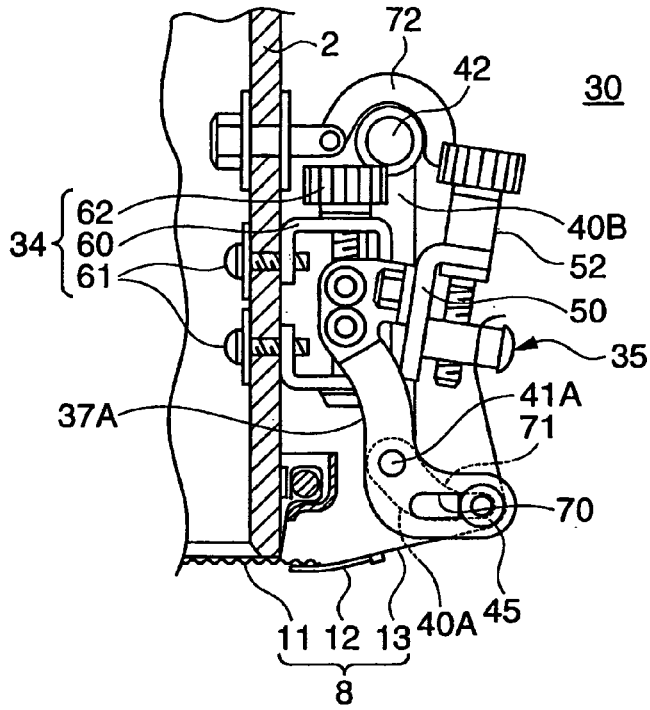
FIG. 8 is a side view partly in cross section showing a modified example of a first strainer in an ON state.
Figure 9:
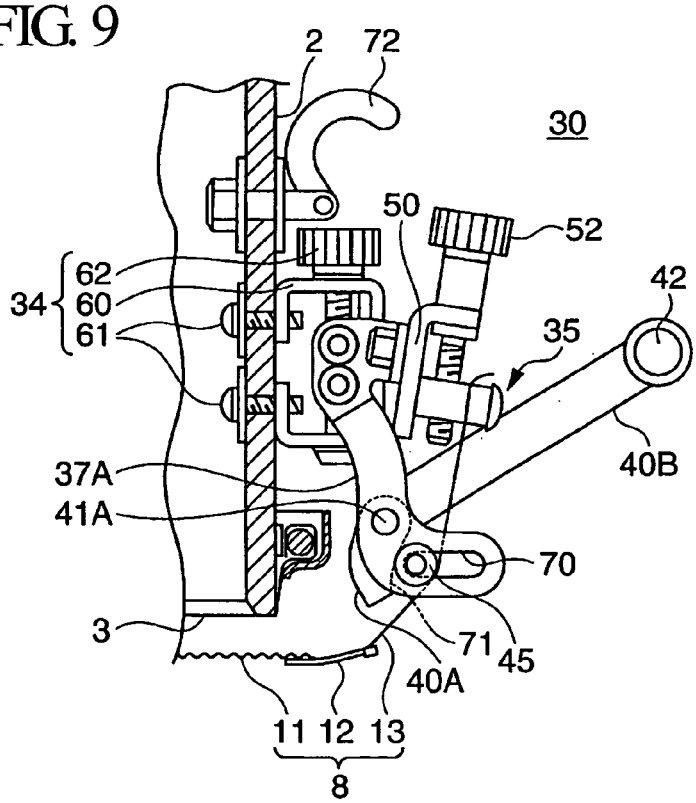
FIG. 9 is a side view partly in cross section showing the modified example of the first strainer in an OFF state.

FIG. 8 is a side view partly in cross section showing a modified example of a first strainer 30 in an ON state; and FIG. 9 is a side view partly in cross section showing the modified example of the first strainer 30 in an OFF state.

The first strainer 30 of the modified example is characterized in that a stretching rod 45 is subjected to linear motion in a horizontal direction perpendicular to an axial line of the drum cylinder 2, whereby the snare assembly 8 moves in close contact with or apart from the bottom-side drumhead 3. Herein, a pair of arms 37A and 37B (where 37B is not shown) each have elongated holes 70, which are elongated in the horizontal direction perpendicular to the axial line of the drum cylinder 2, at the rear ends thereof, wherein both ends of the stretching rod 45 are inserted into the elongated holes 70 of the arms 37A and 37B so that the stretching rod 45 is supported to realize a free linear motion along the elongated holes 70. A pair of levers 40A and 40B are attached to the arms 37A and 37B and are supported to freely rotate about rotation axes 41A and 41B respectively. Surfaces 71 of the levers 40A and 40B, which are arranged opposite to the exterior circumferential surface of the drum cylinder 2, have pressing surfaces for pressing the stretching rod 45. The 'switch' lever 40B has a knob 42 that is locked with a lock member 72 attached to the exterior circumferential surface of the drum cylinder 2 in the ON state in which the snare assembly 8 is stretched under tension and comes in close contact with the bottom-side drumhead 3, wherein the switch lever 40B is held substantially in parallel with the exterior circumferential surface of the drum cylinder 2. In the ON state, the lever 40B presses the stretching rod 45 to move in the right direction in FIG. 8, thus pressing both ends of the stretching rod 45 to terminal ends of the elongated holes 70 opposite to the exterior circumferential surface of the drum cylinder 2 so as to stretch the snare assembly 13 under tension. When the knob 42 of the switch lever 40B is released from the locked state with the lock member 72 and is rotated in the clockwise direction as shown in FIG. 9, the lever 40A correspondingly rotates together with the switch lever 40B so as to release the stretching rod 45 from the pressed state. Thus, the stretching rod 45 is subjected to linear motion along the elongated holes 70 towards the exterior circumferential surface of the drum cylinder 2 due to the tension of the snare assembly 8, so that both ends of the stretching rod 45 are pressed to other ends of the elongated holes 70 close to the exterior circumferential surface of the drum cylinder 2, whereby the snare assembly 8 is loosened so as to move apart from the bottom-side drumhead 3; that is, the snare assembly 8 is switched over from the ON state to the OFF state. Therefore, both ends of the elongated holes 70 serve as stoppers for stopping the stretching rod 45 at ON/OFF positions respectively.

The function of the switch lever 40B can be realized by modifying the stretching rod 45, wherein the stretching rod 45 is elongated so that the elongated portion thereof acts as a knob, by which the stretching rod 45 is directly moved in the horizontal direction. In addition, the terminal ends of the elongated holes 70 opposite to the exterior circumferential surface of the drum cylinder 2 can be modified in L-shapes, on which both ends of the stretching rod 45 are hooked so that the stretching rod 45 can be locked at the ON position. This eliminates the lock member 72 from the snare strainer.

In the present embodiment, wires or strings are used for the snare connection members 13, having flexibility, which are attached to both ends of the snare assembly 8. Of course, this invention is not necessarily limited to the present embodiment; hence, it is possible to use belts having appropriate widths, as shown in FIGS. 10 to 12, for the snare connection members 13.

The moving mechanism adapted to the stretching rod 45 is not necessarily limited to the aforementioned examples and can be modified in a variety of ways. For example, the stretching rod 45 can be subjected to sliding motion along a prescribed slope.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A snare strainer including a first strainer and a second strainer, which are attached to an exterior circumferential surface of a drum cylinder of a snare drum at opposite positions and by which a snare assembly including snares is controlled to move in close contact with or apart from a drumhead of the snare drum, wherein said first strainer comprises a holding member for holding a snare connection member attached to a prescribed end of the snare assembly, and a stretching rod that is movably provided and supports the snare connection member at a portion between the holding member and an outer peripheral end of the drumhead, and wherein the stretching rod moves to vary a distance from the holding member to the outer peripheral end of the drumhead via the stretching rod, thus controlling the snare assembly to move in close contact with or apart from the drumhead and the stretching rod is provided substantially vertical to a height direction of said drum cylinder such that the rod moves close to a side surface of the drum cylinder or separates from the side surface of the drum cylinder.

2. A snare strainer according to claim 1, wherein the first strainer comprises a snare stretching member including the stretching rod and a fixed base for fixing the snare stretching member onto the exterior circumferential surface of the drum cylinder, and wherein the fixed base includes a height adjuster for adjusting a height of the stretching rod, which is measured in level based on the drumhead, by operating the snare stretching member.

3. A snare strainer according to claim 2, wherein the holding member includes a tension adjuster for adjusting tension applied to the snare assembly.

4. A snare strainer according to claim 3, wherein the snare stretching member includes the holding member, an interconnection member for establishing interconnection with the fixed base, and a pair of arms that are elongated from both ends of the interconnection member; a pair of levers, between which the stretching rod is bridged, are respectively attached to the arms so as to freely rotate about rotation axes, whereby by rotating the levers, the snare assembly moves in close contact with or apart from the drumhead.

5. A snare strainer according to claim 2, wherein the snare stretching member includes the holding member, an interconnection member for establishing interconnection with the fixed base, and a pair of arms that are elongated from both ends of the interconnection member; and a pair of levers, between which the stretchhug rod is bridged, are respectively attached to the arms so as to freely rotate about rotation axes, whereby by rotating the levers, the snare assembly moves in close contact with or apart from the drumhead.

6. A snare strainer according to claim 1, wherein the holding member includes a tension adjuster for adjusting tension applied to the snare assembly.

7. A snare strainer according to claim 6, wherein the first strainer includes a snare stretching member and a fixed base for fixing the snare stretching member onto the exterior circumferential surface of the drum cylinder; the snare stretching member includes the holding member, an interconnection member for establishing interconnection with the fixed base, and a pair of arms that are elongated from both ends of the interconnection member; and a pair of levers, between which the stretching rod is bridged, are respectively attached to the arms so as to freely rotate about rotation axes, whereby by rotating the levers, the snare assembly moves in close contact with or apart from the drumhead.

8. A snare strainer including a first strainer and a second strainer, which are attached to an exterior circumferential surface of a drum cylinder of a snare drum at opposite positions and by which a snare assembly including snares is controlled to move in close contact with or apart from a drumhead of the snare drum, wherein said first strainer comprises a holding member for holding a snare connection member attached to a prescribed end of the snare assembly, and a stretching rod that is movably provided and supports a portion between the holding member and an outer peripheral end of the drumhead of the snare connection member, and wherein the stretching rod moves to vary a distance from the holding member to the outer peripheral end of the drumhead via the stretching rod, thus controlling the snare assembly to move in close contact with or apart from the drumhead, the first strainer includes a snare stretching member and a fixed base for fixing the snare stretching member onto the exterior circumferential surface of the drum cylinder; the snare stretching member includes the holding member, an interconnection member for establishing interconnection with the fixed base, and a pair of arms that are elongated from both ends of the interconnection member; and a pair of levers, between which the stretching rod is bridged, are respectively attached to the arms so as to freely rotate about rotation axes, whereby by rotating the levers, the snare assembly moves in close contact with or apart from the drumhead.

* * * * *